US008227038B2

(12) United States Patent
Corcoran

(10) Patent No.: US 8,227,038 B2
(45) Date of Patent: Jul. 24, 2012

(54) ADHESION PROMOTING CLEANER SOLUTION

(75) Inventor: Patrick Henry Corcoran, Cherry Hill, NJ (US)

(73) Assignee: E I du Pont de Nemours and Company, Wilmington, DE (US)

( * ) Notice: Subject to any disclaimer, the term of this patent is extended or adjusted under 35 U.S.C. 154(b) by 362 days.

(21) Appl. No.: 12/523,006

(22) PCT Filed: Jan. 11, 2008

(86) PCT No.: PCT/US2008/000437

§ 371 (c)(1), (2), (4) Date: Jul. 13, 2009

(87) PCT Pub. No.: WO2008/088765

PCT Pub. Date: Jul. 24, 2008

(65) Prior Publication Data

US 2010/0021640 A1 Jan. 28, 2010

Related U.S. Application Data

(60) Provisional application No. 60/880,142, filed on Jan. 12, 2007.

(51) Int. Cl.
*B05D 3/10* (2006.01)

(52) U.S. Cl. ..... 427/302; 134/22.19

(58) Field of Classification Search ..... 427/302; 134/1–42

See application file for complete search history.

(56) References Cited

U.S. PATENT DOCUMENTS

| | | | | |
|---|---|---|---|---|
| 3,652,732 | A | 3/1972 | Markowski et al. | |
| 4,039,593 | A | 8/1977 | Kamienski et al. | |
| 4,518,753 | A | 5/1985 | Richards et al. | |
| 4,997,882 | A | 3/1991 | Martz et al. | |
| 5,039,755 | A | 8/1991 | Chamberlain et al. | |
| 5,115,007 | A | 5/1992 | Chihara et al. | |
| 5,202,050 | A * | 4/1993 | Culshaw et al. | 134/42 |
| 5,221,707 | A | 6/1993 | Chihara et al. | |
| 5,319,032 | A | 6/1994 | Martz et al. | |
| 5,376,745 | A | 12/1994 | Handlin et al. | |
| 5,397,602 | A | 3/1995 | Martz et al. | |
| 5,486,570 | A | 1/1996 | St. Clair | |
| 6,146,706 | A * | 11/2000 | Verardi et al. | 427/393.5 |
| 6,203,913 | B1 * | 3/2001 | Kondos et al. | 428/423.1 |
| 2008/0000498 | A1 * | 1/2008 | Lestage et al. | 134/6 |

FOREIGN PATENT DOCUMENTS

WO WO2006/044506 A1 4/2006

* cited by examiner

*Primary Examiner* — Timothy Meeks
*Assistant Examiner* — Nathan T Leong
(74) *Attorney, Agent, or Firm* — Brian J Myers

(57) ABSTRACT

The present invention relates to an adhesion promoting cleaner solution for producing and adherent coating on a resinous substrate. The adhesion promoting cleaning solution comprises a telechelic diol in a carrier liquid such as an organic solvent. Also disclosed is a process of using the adhesion promoting cleaner solution to produce an adherent coating on a resinous substrate.

16 Claims, No Drawings

ADHESION PROMOTING CLEANER SOLUTION

FIELD OF INVENTION

The present invention is directed towards a cleaning solution containing an adhesion promoting agent. This cleaning solution is used to clean a resinous substrate prior to applying a layer of a coating composition to the substrate.

BACKGROUND OF INVENTION

Resinous materials, such as thermoplastic olefins (TPO), sheet molding compounds (SMC), engineering polymers, such as NORYL® GTX polyamide (PA) reinforced with a modified polyphenylene ether polymer (PPE) supplied by GE Plastics, Fairfield, Conn., and reaction injection molded (RIM) polyurethane are used in many applications, such as automobile parts and accessories, containers, household appliances and other commercial items. It is often desirable to coat articles made from such resinous materials with coatings that are esthetically pleasing. Such coatings are also used to protect such articles from degradation when exposed to atmospheric weathering conditions, such as sunlight, moisture, heat and cold. To produce longer lasting and more durable articles from resinous materials, it is necessary for the coatings to tightly adhere to the surface of such articles.

Resinous substrates made from a variety of thermoplastic and thermosetting resinous materials have widely varying surface properties, including surface tension, roughness, flexibility, and have widely varying bulk properties such as solubility parameter, which make it difficult to achieve adequate adhesion of the coatings to such materials, particularly upon aging or environmental exposure of the resinous materials. It is well known to apply an adhesion promoter or tie coat on a resinous substrate surface to improve adherence of the coating to the surface. The application of an adhesion promoter or tie coat is normally an added step in the coating process. The adhesion promoter is usually applied in a thin layer, normally about 6.35 micrometers (0.25 mils). Typically, adhesion promoters used on TPO plastic surfaces contain chlorinated polyolefins, some examples of which are described in U.S. Pat. Nos. 4,997,882; 5,319,032 and 5,397,602. Additionally, flame or corona pretreatment steps can be also used to facilitate adequate adhesion of organic coatings to some resinous substrates.

The use of adhesion promoters and/or corona pretreatments in a coating system used to coat resinous substrates, adds complexity and cost to the system. The application of an adhesion promoter usually entails coating the resinous substrate with the promoter, followed by some drying or curing time which increases the time of the entire coating process and will usually necessitate additional workspace Accordingly, coating compositions which exhibit excellent adhesion directly to resinous materials, such as TPO and NORYL® GTX polyamide without the use of adhesion promoters or tie coats are desirable.

Polyolefin diols have been used in coating compositions to impart adhesion to the resinous substrate without the use of adhesion promoters or tie coats. However, polyolefin diols may be incompatible with the resins and/or crosslinking agents used in some coating compositions. For example, U.S. Pat. No. 6,203,913 discloses an adhesion promoter containing a mixture of one or more conventional crosslinkable film forming resins having crosslinkable groups, such as those from polyesters, and acrylic polymers; one or more conventional crosslinking materials that are capable of reacting with film forming resins, such as aminoplasts and isocyanates; and an adhesion promoting agent, such as polyolefin diol. However, a need still exists to improve compatibility of the adhesion-promoting agent, film forming resins and crosslinking materials in such coating compositions.

STATEMENT OF INVENTION

In one embodiment of the invention, is disclosed a process for producing an adherent coating on a resinous substrate, comprising the steps of;

i) contacting the surface of said resinous substrate with an adhesion promoting cleaning solution to clean said surface, said cleaning solution comprising at least one telechelic diol in a carrier liquid;

ii) applying a layer of a coating composition on said cleaned surface of said substrate, and curing said layer of said coating composition into said adherent coating on said resinous substrate.

In another embodiment, the process for producing multilayer adherent coating on a resinous substrate comprises the steps of;

iii) contacting the surface of a resinous substrate with an adhesion promoting cleaning solution, iv) applying a layer of a primer coating composition on the cleaned surface of the resinous substrate, v) optionally curing or partially curing said layer of said primer;

vi) applying a layer of a pigmented coating composition over said partially cured layer of said primer; and completing curing of said partially cured layer of said primer and said layer of said pigmented coating composition to form said adherent multi-coating on said resinous substrate.

In another embodiment is disclosed a multicomponent primer system for resinous substrates comprising an adhesion promoting cleaner solution which comprises a telechelic diol. Another embodiment of the invention further discloses a multicomponent primer system for resinous substrates comprising an adhesion promoting cleaner solution which comprises a telechelic diol and a coating composition comprising a crosslinkable component and a crosslinking component.

DETAILED DESCRIPTION OF PREFERRED EMBODIMENT

Unless stated otherwise:

"Low VOC coating composition" means a coating composition that includes in the range of from 0.36 kilograms (0.8 pounds per gallon) to 2.95 kilograms (6.5 pounds per gallon), preferably from 1.18 kilograms (2.6 pounds per gallon) to 2.27 kilograms (5.0 pounds per gallon) and more preferably from 1.27 kilograms (2.8 pounds per gallon) to 2.00 kilograms (4.4 pounds per gallon) of the solvent per liter of the coating composition. All VOC's determined under the procedure provided in ASTM D3960.

"GPC number average molecular weight" means a number average molecular weight measured by utilizing gel permeation chromatography, such as high performance liquid chromatograph (HPLC) supplied by Hewlett-Packard, Palo Alto, Calif. Unless stated otherwise, tetrahydrofuran was used as the liquid phase and polystyrene standards were used.

"Tg" (glass transition temperature) means a temperature measured in ° C. determined by DSC (Differential Scanning Calorimetry) at a rate of heating of 10° C. per minute, with Tg taken at the first inflection point. The Tg of a polymer is a measure of the hardness and melt flow of the polymer. The higher the Tg, the less the melt flow and the harder the coating. Tg is described in Principles of Polymer Chemistry (1953), Cornell University Press. The Tg can be actually measured or it can be calculated as described by Fox in Bull. Amer. Physics Soc., 1, 3, page 123 (1956). Tg, as used herein, refers to actually measured values.

"(Meth)acrylate" means acrylate and methacrylate.

"Polymer solids" or "composition solids" means a polymer or composition in its dry state.

"Crosslinkable component" means a component that includes a compound, polymer, copolymer or a polydisperse mixture of compounds, polymers and/or copolymers all having functional groups positioned in the backbone, pendant from the polymer backbone, terminally positioned on the polymer backbone; or a combination thereof.

"Crosslinking component" is a component that includes a compound, polymer, oligomer, copolymer or a polydisperse mixture of compounds, polymers, oligomers, and/or copolymers all having functional groups positioned in the backbone, pendant from the polymer backbone, terminally positioned on the polymer or oligomer backbone; or a combination thereof, wherein these functional groups are capable of crosslinking with the functional groups on the crosslinkable component (during the curing step) to produce a coating in the form of crosslinked structures.

"Ambient cure condition" is generally defined as the temperature range of 12° C. to 45° C. (54° F. to 113° F.) and a humidity range of 5% to 95% that is present in the spraying area.

"Untreated resinous substrate" means a thermoplastic or thermosetting substrate that has not been pretreated using any means to increase the adhesion of a subsequent coating applied over the substrate. Such treatment methods are well known in the art, such as flame or corona treatments or treating the resinous surface with an adhesion promoter or tie coat to help increase adhesion to the coating composition. A typically used conventional adhesion promoter contains a chlorinated polyolefin. Each of these adhesion-promoting methods increases the complexity and cost of coating such substrates.

The resinous substrates suitable for use in the present invention can include any of the thermoplastic or thermosetting synthetic materials commonly used in injection molding, sheet molding, blow molding, vacuum forming or other similar process in which parts are formed. Some of the more suitable resinous substrate include polyolefins such as those made from polyethylene, polypropylene, polybutylene, isotactic polypropylene reinforced with a polyethylene-alpha olefin copolymer; polyamides and polyamides reinforced with a polyphenyleneether, sheet molding compound or a copolymer of acrylonitrile, butadiene and styrene (ABS). However, reaction injection molding compounds (RIMs) such as reaction injecting molding urethanes are not part of this invention unless they have been reinforced (RRIMs) with conventional reinforcing agents, such as short glass fibers or mineral fillers (mica, wollastonite and others). One example of suitable RRIM is known as BAYFLEX® 190 polyurethane/polyurea RRIM system (reinforced with 15% mica) from Bayer MaterialScience, Pittsburgh, Pa.

"Two-pack coating composition" means a curable coating composition having two components stored in separate containers. The containers containing the two components are typically sealed to increase the shelf life of the components of the coating composition. One such component of the two-pack coating composition is a crosslinkable component and the other is a crosslinking component. These components are mixed prior to use to form a pot mix. The pot life of a pot mix is limited, typically to a few minutes (10 minutes to 45 minutes) to a few hours (4 hours to 24 hours). The crosslinking component of this composition includes polyisocyanates. The pot mix is applied as a layer of a desired thickness on a substrate surface, such as an auto body. After application, the layer dries and cures at ambient or elevated temperatures to form a coating on the substrate surface having desired coating properties, such as improved adhesion and chip resistance.

"One-pack coating composition" means a curable coating composition having both the crosslinkable component and the crosslinking component stored together in one pack. The crosslinking component of this composition is selected from the group consisting of blocked polyisocyanates, and mixtures thereof. Typical blocking agents for polyisocyanates include alcohols, ketimines, and oximes. One-pack coating compositions are applied to a suitable substrate and are cured at elevated temperatures to form a durable coating. Since the coating composition of the present invention is directed to a composition that adheres to plastic substrates, the curing temperature should be below that of the softening point of the substrate when formulating and curing a one-pack coating composition. A two-pack coating composition is preferred.

The use of numerical values in the various ranges specified herein is stated as approximations as though the minimum and maximum values within the stated ranges were both being preceded by the word "about." In this manner slight variations above and below the stated ranges can be used to achieve substantially the same results as values within the ranges. Also, the disclosure of these ranges is intended as a continuous range including every value between the minimum and maximum average values including fractional values that can result when some of components of one value are mixed with those of different value. Moreover, when broader and narrower ranges are disclosed, it is within the contemplation of this invention to match a minimum value from one range with a maximum value from another range and vice versa.

It has been found that adding a telechelic diol to a plastic cleaning solution produces an adhesion promoting cleaning solution and decreases the amount of telechelic diol needed in the coating composition to achieve adhesion to the resinous substrate. The term "telechelic diol" means a predominantly hydrocarbon polymer have terminal hydroxy groups.

While not wishing to be bound by theory, it is believed that the solvent of the cleaning solution swells the resinous substrate allowing the telechelic diol to intermix and entangle with the resin. As the solvent evaporates, the telechelic diol remains intimately mixed with the resin. A coating composition, containing a crosslinking component, is then applied. The crosslinking component, preferably containing isocyanate functionalities, is able to incorporate the terminal hydroxy groups of the telechelic diol into the curing coating composition thereby creating an adherent coating on the resinous substrate. As the telechelic diol remains after the cleaning solvent has evaporated, the adhesion promoting cleaning solution can be thought of as a primer system for resinous substrates.

As used herein, a "predominantly hydrocarbon polymer", means a saturated hydrocarbon polymer containing about 85 to about 99 weight percent of hydrocarbon units. The saturated hydrocarbon polymer contains less than about 13 percent by weight of heteroatoms, such as oxygen, nitrogen and sulfur. Preferably, the saturated hydrocarbon polymer contains less than 6 percent by weight of heteroatoms, more preferably less than 3 percent, and most preferably less than 1 percent. Typically, the number average molecular weight of the saturated hydrocarbon polymer ranges from about 1000 to 20,000.

The saturated hydrocarbon polymer contains an average of more than one terminal or pendant functional group per molecule, which is capable of reacting with the crosslinking material of the crosslinkable film-forming system. Preferably, the saturated hydrocarbon polymer, which can be present as a mixture of different saturated hydrocarbon polymers, contains an average of about 1.5 to about 6 terminal or pendent functional groups per molecule. More preferably, the saturated hydrocarbon polymer contains two terminal functional groups per molecule.

The functional groups of the saturated hydrocarbon polymer can be carboxyl groups, carbamate groups, hydroxyl groups, amino groups, amide groups, mercaptan groups and mixtures thereof. Preferably, the functional groups are hydroxyl groups. More preferably, the saturated hydrocarbon polymer contains two terminal hydroxyl groups.

The saturated hydrocarbon polymer is at least "substantially saturated", i.e., the hydrocarbon polymer has been hydrogenated, usually after polymerization, such that at least about 90 percent and preferably at least about 95 percent of the carbon to carbon double bonds of the hydrocarbon polymer are saturated. Methods for hydrogenating unsaturated hydrocarbon polymers are well known to those skilled in the art. Examples of useful hydrogenation processes include hydrogenation in the presence of catalysts, such as Raney Nickel; noble metals, such as platinum; soluble transition metal catalysts; and titanium catalysts disclosed in U.S. Pat. No. 5,039,755.

In a preferred embodiment, the saturated hydrocarbon polymer comprises one or more substantially saturated polyhydroxylated polydiene polymers. Polyhydroxylated polydiene polymers made using isoprene or butadiene, as described in U.S. Pat. No. 5,486,570 and U.S. Pat. No. 5,376,745, which are substantially saturated, are suitable for use in the present invention. Preferably the saturated hydrocarbon polymer is formed from saturated polybutadiene. Polyhydroxylated polydiene polymers of this type generally have a hydroxyl equivalent weight of between about 500 and about 20,000. Preferably, the saturated polyhydroxylated polydiene polymer is a dihydroxy polybutadiene which contains about two terminal hydroxyl groups, one at each end of the polymer, and has a hydroxyl equivalent weight of about 1,000 to about 5000.

Suitable substantially saturated polyhydroxylated polydiene polymers include those synthesized by free radical polymerization of dienes or anionic polymerization of conjugated diene hydrocarbons, such as butadiene or isoprene, with lithium initiators. The process steps for preparing polyhydroxylated polydiene polymers by anionic polymerization are described in U.S. Pat. No. 4,039,593; Re. 27,145; and U.S. Pat. No. 5,376,745. Such polymers are typically made with a di-lithium initiator, such as a compound formed by reaction of two moles of sec-butyl lithium with one mole of diisopropylbenzene. The polymerization of butadiene can be performed in a solvent composed of 90 percent by weight cyclohexane and 10 percent by weight diethyl ether. The molar ratio of diinitiator to monomer determines the molecular weight of the polymer. The polymer is capped with two moles of ethylene oxide and terminated with two moles of methanol to produce the dihydroxy polybutadiene. The most preferred saturated hydrocarbon polymer is a telechelic diol. Suitable telechelic diols include KRATON® liquid polymers HPVM 2200 series and Shell Diol L-2203, which are commercially available from Shell Chemical Co, Houston, Tex. and KRASOL® HLBH-P 3000 polybutadiene from Sartomer Resins, West Chester, Pa.

Other suitable substantially saturated polyhydroxylated polydiene polymers preferably have at least about 90 weight percent repeat units derived from conjugated dienes. The monomers used to form the polymers include olefins having from 2 to 6 carbon atoms such as are disclosed in U.S. Pat. No. 4,518,753 and U.S. Pat. No. 3,652,732. Optionally the polyhydroxylated polydiene polymers can be formed from up to 50 mole percent of ethylenically unsaturated comonomers having from 2 to 10 carbon atoms and substituents including aromatics, halogens, cyanides, esters, and hydroxy esters. Examples of such polymers are hydroxyl terminated diene-based polymers including anionically polymerized dienes, which are given hydroxyl groups in the chain termination step, or free radically polymerized dienes such as those initiated with hydrogen peroxide. Such hydrogenated substantially saturated polyhydroxylated polydiene polymers are described in U.S. Pat. No. 5,115,007 and U.S. Pat. No. 5,221,707. These polymers preferably have a Mn ranging from about 500 to about 20,000 and more preferably about 1,000 to about 8,000 grams per mole and have from 2 to 6 and more preferably from 2 to 4 hydroxyl end groups per polymer chain.

Plastic cleaning solutions are commercially available. For example, PLAS-STICK® 2320 plastic cleaner is available from the DuPont Company, Wilmington, Del. Useful plastic cleaning solutions typically comprise an organic carrier liquid which is an organic solvent or a combination of organic solvents. Commonly used solvents for the plastic cleaning solutions include aromatics such as toluene, xylenes; alkanes and cycloalkanes containing from 5 to 20 carbon atoms such as hexanes, cyclohexanes, heptanes; ketones such as acetone, methyl isobutyl ketone, methyl amyl ketone; esters such as ethyl acetate, butyl acetate; ethers such as diethyl ether and dibutyl ether; or a combination thereof. Preferably, the solvent is toluene, xylenes; alkanes and cycloalkanes containing from 5 to 20 carbon atoms such as hexanes, cyclohexanes, heptanes; ketones such as acetone, methyl isobutyl ketone, methyl amyl ketone; esters such as ethyl acetate; ethers such as diethyl ether and dibutyl ether; or a combination thereof. Preferably, the telechelic diol is soluble in the plastic cleaning solution.

The telechelic diol is used in the range of from 0.1 percent to 20 percent by weight of the solvent. Preferably the telechelic diol is used in the range of from 0.5 to 10 percent by weight of the solvent, and more preferably it is used in the range of from 1 percent to 6 percent by weight of the solvent. To produce the adhesion promoting cleaning solution, the telechelic diol and the solvent or solvent system is mixed until a solution is formed.

Once the resinous substrate is cleaned with the adhesion promoting cleaning solution, a coating composition can be applied. The coating composition comprises a crosslinkable component and a crosslinking component. The coating composition may further comprise a telechelic diol.

The crosslinkable component is selected from the group consisting of acrylic polyol, polyester polyol, and a combination thereof. The crosslinkable component is present in an amount in the range of from 20 to 80 percent by weight, preferably in the range of from 30 to 70 percent by weight, more preferably in the range of from 40 to 60 percent by weight, all percentages are based on the total amount of the crosslinkable component, the crosslinking component and the optional telechelic diol.

Suitable acrylic polyols can have a GPC number average molecular weight in the range of from 2,000 to 20,000 preferably 2,200 to 8,000 and more preferably 2,500 to 6,000, and can have a Tg in the range of from −40° C. to +70° C., preferably −30° C. to +50° C. and more preferably −20° C. to 30° C. The acrylic polyols have a hydroxyl number in the range of from 2 to 150, more preferably in the range of from 3 to 125, most preferably in the range of from 5 to 100.

The acrylic polyol is produced by the polymerization of a monomer mixture comprising one or more ethylenically unsaturated monomers. Some of the suitable ethylenically unsaturated monomers include acrylic ester monomers, such as hydroxy alkyl(meth)acrylates wherein alkyl group includes 1 to 4 carbon atoms. Some examples of hydroxy alkyl (meth)acrylates include hydroxyethyl(meth)acrylate (primary), hydroxybutyl(meth)acrylate (all isomers, primary and secondary) and hydroxypropyl(meth)acrylate (all isomers, primary and secondary). The monomer mixture can further include the following ethylenically unsaturated monomers which include acrylic ester monomers, such as methyl(meth)acrylate, ethyl(meth)acrylate, butyl(meth)acrylate, cyclohexyl(meth)acrylate, 2-ethylhexyl(meth)acrylate, decyl (meth)acrylate, lauryl(meth)acrylate, isobornyl(meth) acrylate, isodecyl (meth)acrylate, oleyl(meth)acrylate, palmityl(meth)acrylate, stearyl (meth)acrylate, and acetoacetoxy ethyl(meth)acrylate; acrylamide or substituted acrylamides; styrene or alkyl substituted styrenes; butadiene; ethylene; vinyl acetate; vinyl ester of "Versatic" acid (a tertiary monocarboxylic acid having $C_9$, $C_{10}$ and $C_{11}$ chain length); vinyl monomers, such as, for example, vinyl chloride, vinylidene chloride, vinyl pyridine, N-vinyl pyrrolidone; amino monomers, such as, for example, N,N'-dimethylamino (meth)acrylate; chloroprene and acrylonitrile or methacrylonitrile; carboxyl monomers, such as acrylic acid, methacrylic acid, crotonic acid, itaconic acid, fumaric acid, maleic acid, monomethyl itaconate, monomethyl fumarate, monobutyl fumarate, maleic anhydride, 2-acrylamido-2-methyl-1-propanesulfonic acid, sodium vinyl sulfonate, and phosphoethyl methacrylate.

One preferred acrylic polyol is polymerized from a monomer mixture of about 10 to 30% by weight cyclohexyl(meth) acrylate, 10 to 70% by weight ethyihexyl(meth)acrylate, 5 to 25% by weight hydroxyethyl (meth)acrylate, and optionally up to 30% by weight styrene, and up to 30% by weight methyl(meth)acrylate, all weight percentages based on the total weight of the acrylic polyol.

Suitable polyester polyols can have a GPC number average molecular weight in the range of from 2,000 to 20,000, preferably 2,200 to 8,000 and more preferably 2,500 to 6,000 and can have a Tg in the range of from −40° C. to +40° C., preferably −30° C. to +30° C. and more preferably −20° C. to 20° C. The polyester polyols have a hydroxyl number in the range of from 2 to 200, more preferably in the range of from 2 to 175, most preferably in the range of from 5 to 150.

The polyester polyol is produced from the polycondensation of at least one polyol with at least one polycarboxylic acid or anhydride.

Suitable polyols include ethylene glycol, propanediols, butanediols, hexanediols, neopentylglycol, diethylene glycol, cyclohexanediol, cyclohexanedimethanol, trimethylpentanediol, ethyl butylpropanediol, ditrimethylolpropane, trimethylolethane, trimethylolpropane, glycerol, pentaerythritol, dipentaerythritol, glycerol; polyalkylene glycols such as, polyethylene glycol and polypropylene glycol, and PRIPOL® dimer diols, available from Uniqema Chemicals, Wilmington, Del.

Suitable polycarboxylic acids and/or anhydrides that can be used are aliphatic dicarboxylic acids such as maleic acid, maleic anhydride, adipic acid and sebacic acid, 1,4-cyclohexanedicarboxylic acid, hexahydrophthalic acid, hexahydrophthalic anhydride, methyl-hexahydrophthalic acid, methylhexahydrophthalic anhydride, azelaic acid and 1,12-dodecanedioc acid; aromatic dicarboxylic acids and anhydrides such as phthalic acid, phthalic anhydride, isophthalic acid, terephthalic acid, PRIPOL® dimer acids, available from Uniqema Chemicals, Wilmington, Del., or a combination thereof.

One preferred polyester is produced from a mixture of about 10 to 15 percent by weight cyclohexyl dimethanol, 30 to 35 percent by weight PRIPOL® dimer diol, 5 to 10 percent by weight trimethyol propane, 10 to 15 percent by weight hexahydrophthalic anhydride, and 30 to 40 percent by weight PRIPOL® dimer acid.

Where a combination of an acrylic polyol and a polyester polyol is used, the acrylic polyol can be used in the range of from 1 percent by weight to 99 percent by weight based upon the total weight of the acrylic polyol and the polyester polyol. Preferably, the acrylic polyol is used in the range of from 10 percent to 90 percent and more preferably in the range of from 20 to 80 percent by weight based upon the total weight of the acrylic polyol and the polyester polyol. The polyester polyol can be used in the range of from 1 percent by weight to 99 percent by weight based upon the total weight of the acrylic polyol and the polyester polyol. Preferably, the acrylic polyol is used in the range of from 90 percent to 10 percent and more preferably in the range of from 80 to 20 percent by weight based upon the total weight of the acrylic polyol and the polyester polyol.

While not necessary, a telechelic diol, as described above, can be added to the coating composition to aid adhesion to the resinous substrate. Typically, only small amounts of the telechelic diol are added to the coating composition. The amount used is in the range of from 0.5 percent by weight to less than 5 percent by weight, preferably, 0.6 percent by weight to 4.9 percent by weight, more preferably from 1.0 percent by weight to 4.75 percent by weight. All weight percentages are based upon the total amount of crosslinkable component and crosslinking component.

The coating composition comprises a crosslinkable component, a crosslinking component. The preferred crosslinking component is a polyisocyanate, more preferably, a cycloaliphatic polyisocyanate.

Cycloaliphatc polyisocyanates are preferred for use in the present invention and are of the formula:

$$R^1—(R^2—NCO)_n$$

wherein $R^1$ is a cycloaliphatic group which can be optionally bridged. $R^1$ contains 3 to 20, preferably 4 to 10 and more preferably 5 to 8 carbon atoms in the ring. $R^2$ is independently chosen from a direct bond or a straight or branched aliphatic group having from 1 to 6 carbon atoms, preferably 1 to 4 and more preferably 1 to 2 and wherein n ranges from 2 to 10, preferably from 2 to 8 and more preferably from 2 to 5. The preferred isocyanate is chosen from the monomeric form of the isocyanate or the so-called 'homopolymer isocyanates' resulting from the isocyanates being dimerized, trimerized, or other wise oligomerized via known methods. One such preferred example is the isocyanurate trimer of isophorone diisocyanate available from Bayer Material Science, Pittsburgh, Pa. under the trade mark Desmodur® Z4470.

Some of examples of suitable cycloaliphatic polyisocyanates include di-, tri- or tetraisocyanates which may or may not be ethylenically unsaturated, such as, 1,3cyclopentane diisocyanate, 1,2-cyclohexane diisocyanate, 1,4-cyclohexane diisocyanate, isophorone diisocyanate, 4-methyl-1,3-diisocyanatocyclohexane, dicyclohexylmethane4,4'-diisocyanate, 3,3'-dimethyl-dicyclohexylmethane-4,4'-diisocyanate, polyisocyanates having isocyanurate structural units, the adduct of 2 molecules of a diisocyanate, such as isophorone diisocyanate, and a diol such as ethylene glycol, the adduct of 1 molecule of trimethylol propane and 3 molecules of isophorone diisocyanate.

If desired, the crosslinking component can include other polyisocyanates, such as 1,2-propylene diisocyanate, trimethylene diisocyanate, tetramethylene diisocyanate, 2,3-butylene diisocyanate, hexamethylene diisocyanate, octamethylene diisocyanate, 2,2,4-trimethyl hexamethylene diisocyanate, 2,4,4-trimethyl hexamethylene diisocyanate, dodecamethylene diisocyanate, omega, omega-dipropyl ether diisocyanate, trans-vinylidene diisocyanate, toluene diisocyanate, 1,3-bis(1-isocyanato 1-methylethyl)benzene, 1,4-bis(1-isocyanato-1-methylethyl)benzene, 1,3-bis(isocyanatomethyl)benzenexylene diisocyanate, 1,5-dimethyl-2,4-bis(isocyanatomethyl)benzene, 1,5-dimethyl-2,4-bis(2-isocyanatoethyl)benzene, 1,3,5-triethyl-2,4-bis(isocyanatomethyl)benzene, 4,4'-diisocyanatodiphenyl, 3,3'-dichloro-4,4'-diisocyanatodiphenyl, 3,3'-diphenyl-4,4'-diisocyanatodiphenyl, 3,3'-dimethoxy4,4'-diisocyanatodiphenyl, 4,4'-diisocyanatodiphenylmethane, 3,3'-dimethyl4,4'-diisocyanatodiphenyl methane, diisocyanatonaphthalene, and combination thereof.

Preferably, the crosslinking component can include small amount of other polyisocyanates, such as one or more trimers of hexamethylene diisocyanate, meta-tetramethylxylylene diisocyanate, toluene diisocyanate, or a combination thereof.

When the aforedescribed polyisocyanates are used, the crosslinkable component is stored separately from the crosslinking component as part of a two-pack coating composition, wherein these components are mixed prior to use to form a pot mix, which is then applied by conventional means such as spraying devices or roller applicators over the resinous substrates.

Alternatively, the isocyanates groups on the aforedescribed polyisocyanates can be blocked with a monomeric alcohol to prevent premature crosslinking in a one-pack coating composition. Some of the suitable monomeric alcohols include methanol, ethanol, propanol, butanol, isopropanol, isobutanol, hexanol, 2-ethylhexanol and cyclohexanol. The preferred monomeric alcohols are 2-ethylhexanol and cyclohexanol.

The coating composition typically includes one or more solvents such as organic solvent selected from aromatic hydrocarbons, such as petroleum naphtha or xylenes; ketones, such as, methyl amyl ketone, methyl isobutyl ketone, methyl ethyl ketone or acetone; esters, such as, butyl acetate or hexyl acetate; glycol ether esters, such as propylene glycol monomethyl ether acetate; and combination thereof. The composition generally includes in the range of 10% to 85%, preferably 20% to 60%, more preferably 30% to 40% of the aforedescribed solvents, all the percentages being in weight percent based on the total weight of the coating composition. The solvent or a mixture of solvents is typically included in the crosslinking and crosslinkable components. Preferably, the solvent is selected or the mixture of solvents is adjusted to render the crosslinkable copolymer miscible in it.

The coating composition of the present invention can also contain conventional additives, such as pigments, pigment dispersants, stabilizers, rheology control agents, flow agents, toughening agents and fillers. Selection of such additional additives would, obviously, depend on the intended use of the coating composition. The foregoing additives may be added to either the crosslinkable or crosslinking component, or both, depending upon the intended use of the coating composition. When the present coating composition is used as a basecoat, typical pigments that can be added to the composition include the following: metallic oxides, such as titanium dioxide, zinc oxide, iron oxides of various colors, carbon black; filler pigments, such as talc, china clay, barytes, carbonates, silicates; and a wide variety of organic colored pigments, such as quinacridones, copper phthalocyanines, perylenes, azo pigments, indanthrone blues, carbazoles, such as carbazole violet, isoindolinones, isoindolones, thioindigo reds, benzimidazolinones; metallic flake pigments, such as aluminum flakes.

In addition to the foregoing, to improve weatherability of a clearcoat or pigmented topcoat of the coating composition, the coating composition when formulated as a clear composition can include about 0.1 to 5% by weight, based on the weight of the composition solids, of an ultraviolet light stabilizer or a combination of ultraviolet light stabilizers and absorbers may be added. These stabilizers include ultraviolet light absorbers, screeners, quenchers and specific hindered amine light stabilizers. Also, about 0.1 to 5% by weight, based on the weight of the composition solids, of an antioxidant can be added. Most of the foregoing stabilizers are supplied by Ciba Specialty Chemicals, Tarrytown, N.Y.

In use, when the coating composition is packed as a two pack coating composition, the crosslinkable and crosslinking components of the coating composition are mixed just prior to use to form a pot mix, which has limited pot life typically ranging from 10 minutes to 24 hours. A pot mix layer is typically applied to a substrate by conventional techniques, such as spraying, electrostatic spraying, roller coating, dipping or brushing. The pot mix layer then cures under ambient conditions in the range of 10 minutes to 24 hours, preferably in the range of 60 minutes to 16 hours or overnight to form a coating on the substrate having the desired coating properties. It is understood that the actual curing time depends upon the thickness of the applied layer, the type of crosslinking chemistry being used and on the presence or absence of any suitable drying devices, such as fans that assist in continuously flowing air over the coated substrate to accelerate the dry rate. If desired, baking the coated substrate at a temperature of about 60° C. to 100° C. for about 10 minutes to about 60 minutes may further accelerate the cure rate. The foregoing baking step is particularly useful under OEM (Original Equipment Manufacture) conditions.

When the coating composition is packaged as a one-pack composition, a layer of the coating composition is applied in a manner similar to that described earlier. However, since the crosslinking groups in the crosslinking components are blocked, the layer is typically subjected to bake cure temperatures to unblock the crosslinking groups so that they can crosslink with the crosslinkable groups presented in the crosslinkable component. Typically baking step takes place at baking temperatures ranging from 60° C. to 200° C., preferably ranging from 80° C. to 160° C., for about 10 minutes to 60 minutes.

The coating composition may be used as a primer coat, a basecoat in a basecoat/clearcoat system, a clearcoat in a basecoat/clearcoat system, or in a topcoat in a single coat or multi-coat system. Each of these systems is well known in the art.

The process for producing an adherent coating on a resinous substrate comprises the steps of;

i) contacting a resinous substrate with an adhesion promoting cleaning solution to clean the surface of the substrate;
ii) applying a layer of a coating composition to the cleaned surface; and
iii) curing the applied layer of coating composition.

In another embodiment, the process for producing multilayer adherent coating on a resinous substrate comprises the steps of;

i) contacting the surface of a resinous substrate with an adhesion promoting cleaning solution,
ii) applying a layer of a primer coating composition on the cleaned surface of the resinous substrate, iii) optionally curing or partially curing said layer of said primer;

iv) applying a layer of a pigmented coating composition over said partially cured layer of said primer; and v) completing curing of said partially cured layer of said primer and said layer of said pigmented coating composition to form said adherent multi-coating on said resinous substrate.

In another embodiment of the present invention, the process for producing an adherent multilayer coating on a resinous substrate further comprises the step applying a layer of clearcoat composition to the pigmented coating composition prior to curing the at least partially cured primer composition. After the clearcoat composition is applied, the combined layers of primer coating composition, pigmented coating composition, and clearcoat composition are cured to form an adherent multilayer coating on a resinous substrate.

The suitable substrates for applying the coating composition of the present invention include resinous automobile bodies, fenders, body inserts or body panels, automobile interior parts, any and all resinous items manufactured and painted by automobile sub-suppliers, commercial resinous truck bodies, including but not limited to beverage transport truck bodies, utility bodies, ready mix concrete delivery vehicle bodies, waste hauling vehicle bodies, and fire and emergency vehicle bodies, as well as any-potential resinous attachments or components to such truck bodies, buses, farm and construction equipment, truck caps and covers, commercial trailers, consumer trailers, recreational vehicles, including but not limited to, motor homes, campers, conversion vans, vans, pleasure vehicles, pleasure craft snow mobiles, all terrain vehicles, personal watercraft, motorcycles, bicycles, boats, and aircraft. The resinous substrate further includes those used in industrial and commercial new construction and maintenance thereof, amusement park equipment; railroad cars; machinery; OEM tools; signage; fiberglass structures; toys, sporting goods; golf balls; and sporting equipment.

EXAMPLES

Test Procedures

X-Hatch adhesion—Using a sharp razor blade, scalpel, knife or other cutting device, two cuts are made into the coating with a 30-45 degree angle between legs and down to the substrate which intersects to form an "X". A steel or other hard metal straightedge is used to ensure straight cuts Tape is placed on the center of the intersection of the cuts and then removed rapidly. The X-cut area is then inspected for removal of coating from the substrate or previous coating and rated. A standard method for the application and performance of this test is given as ASTM D6677. For the purposes of this invention, the adhesion is rated on a sliding scale, which ranges from 0 (no adhesion, i.e., total failure) to 10 (complete adhesion, i.e., total success). A rating of 6 and higher is preferable and a rating of 9 and higher is more preferable.

Cross Hatch adhesion—The cross hatch tape test is primarily intended for use in the laboratory on coatings less than 5 mils (125 microns) thick. It uses a cross hatch pattern rather than the X pattern. A cutting guide or a special cross hatch cutter with multiple preset blades is needed to make sure the incisions are properly spaced and parallel. After the tape has been applied and pulled off, the cut area is then inspected and rated. The foregoing test is based on a standard method for the application and performance of these adhesion tests available in ASTM D3359. For the purposes of this invention, the adhesion is rated on a sliding scale, which ranges from 0 (no adhesion, i.e., total failure) to 10 (complete adhesion, i.e., total success). A rating of 6 and higher is preferable and a rating of 9 and higher is more preferable.

KRASOL® HLBH-P 3000 and KRASOL® HLBH-P 2000 polybutadienes are available from Sartomer Resins, West Chester, Pa.

PLAS-STICK® 2320 plastic cleaners are available from the DuPont Company, Wilmington, Del.

DESMODUR® Z4470 polyisocyanate were supplied from Bayer MaterialScience, Pittsburgh, Pa.

Desmodur® N3300 polyisocyanate were supplied from Bayer MaterialScience, Pittsburgh, Pa.

Zinc catalyst is 0.05 weight percent of dibutyltindilaurate and 0.05 weight percent of zinc naphthenate.

VAZO® 67 thermal initiator were supplied from the Dupont Company, Wilmington, Del.

AROMATIC® 150 aromatic solvent blend was supplied by ExxonMobil, Houston, Tex.,

Thermoplastic polyolefin panels are available from ACT Laboratories, Wixom, Mich.

Unless otherwise specified, all chemicals are available from the Aldrich Chemical Company, Milwaukee, Wis.

Cleaning Solutions

The following cleaning solutions were prepared by adding KRASOL® HLBH-P 3000 polybutadiene to the solvent listed and mixing until a homogeneous solution was formed. All amounts shown in table 1 are in parts by weight.

TABLE 1

| Cleaning Solution | Solvent | | Telechelic diol[1] | Weight percent of telechelic diol |
|---|---|---|---|---|
| 1 | Xylenes | 654 | 36 | 5.2 |
| 2 | Butyl Acetate | 667 | 36 | 5.1 |
| 3 | Heptane | 525 | 36 | 6.4 |
| 4 | Methyl isobutyl ketone | 606 | 36 | 5.6 |
| 5 | PLAS-STICK ® 2320 plastic cleaner | 598 | 36 | 5.7 |

[1]KRASOL ® HLBH-P 3000 polybutadiene

Comparative Plastic Cleaner is PLAS-STICK® 2320 plastic cleaner with no added telechelic diol.

Preparation of Acrylic Polyol #1

A reactor equipped with a stirrer, condenser, an addition funnel and a nitrogen blanket was charged with 36.24 grams of butyl acetate. The reactor was then heated to reflux. The addition funnel was charged with a mixture of 64.0 grams of cyclohexyl methacrylate, 16.0 grams of 2-ethylhexyl methacrylate, 20.0 grams of 2-hydroxyethyl methacrylate, 11.26 grams of ethyl acetate and 3.0 grams of VAZO® 67 thermal initiator. The aforedescribed mixture was added to the reactor over a three-hour period while maintaining the reflux. When the addition was complete, the addition funnel was charged with an additional 1.0 grams of VAZO®67 thermal initiator and 16.67 grams of ethyl acetate. This mixture was added to the reactor over a one hour period while maintaining reflux. When the aforedescribed addition was complete, the reaction was held at reflux for one hour then cooled. The solids content of solution was adjusted to 59.70% and the solution had a Gardner-Holdt viscosity of Q.

Preparation of Coating Composition A

The following ingredients were added, in the order shown, to a mixing vessel. The composition was used immediately. All amounts shown are in parts by weight.

| | |
|---|---|
| Acrylic polyol #1 | 35.54 |
| Dibutyl tin dilaurate | 4.96 |
| Zinc catalyst | 1.24 |
| AROMATIC ® 150 | 2.59 |
| DESMODUR ® Z-4470 | 5.66 |

Thermoplastic polyolefin panels were prepared by wiping with a cleaner solution. Each of cleaning solutions 1-5 was used to wipe a panel. A clean cloth was saturated with the cleaning solution of table 1, and then wiped over the one surface of the panel and the panels were allowed to dry. Coating composition A was then applied to the cleaned surface of the panels with a bird type applicator having a 0.254 mm (0.010 inch) clearance. The panels were flashed for 30 minutes then baked in an oven at 82° C. (180° F.) for 30 minutes. After the panels had cooled for one hour, the coating was tested for X-hatch and cross hatch adhesion and retested after 3 days. The results are shown in Table 2.

TABLE 2

| Cleaning Solution | X Hatch (1 hour) | Cross Hatch (1 hour) | X Hatch (3 day) | Cross Hatch (3 day) |
|---|---|---|---|---|
| 1 | 10 | 10 | 10 | 10 |
| 2 | 0 | 3 | 1 | 4 |
| 3 | 10 | 10 | 10 | 10 |
| 4 | 10 | 10 | 10 | 10 |
| 5 | 10 | 10 | 10 | 10 |

From the foregoing experiment it is clear that a coating composition having no telechelic dial in the coating composition can be applied to polyolefin panels cleaned with the inventive plastic cleaner solution to produce an adherent coating. It is believed that butyl acetate does not swell this plastic substrate to an appreciable degree so that migration of the telechelic diol can occur into the thermoplastic substrate.

Preparation of Polyester #1

A reactor equipped with a stirrer, condenser, an addition funnel and a nitrogen blanket was charged with 200.18 parts neopentyl glycol, 54.96 parts 1,6-hexane diol, 115.29 parts trimethylol propane, 94.58 parts isophthalic acid, 114.39 parts adipic acid, 180.24 parts dodecanedioc acid, and 63.64 parts of phthalic anhydride. This mixture was heated to 243° C. and held at this temperature until the acid number was in the range of from 2 to 5. The heating source was removed and a mixture of 62 part, 74 parts of xylene, 15 parts toluene, and 77 parts of methyl ethyl ketone was added. The resulting polyester had a weight average molecular weight of 12,000, a Tg of 21° C., and a total solids percentage of 59.7.

Preparation of Coating Composition B-I

The ingredients of Table 3 were mixed in the order shown in a mixing vessel to form coating compositions B-I. All amounts shown are in parts by weight.

TABLE 3

| | Coating Composition | | | | | | | |
|---|---|---|---|---|---|---|---|---|
| Ingredient | B | C | D | E | F | G | H | I |
| Acrylic Polyol #1 | 36.19 | 32.01 | 34.66 | 29.89 | 0 | 0 | 0 | 0 |
| Polyester #1 | 0 | 0 | 0 | 0 | 25.19 | 21.12 | 23.75 | 19.27 |
| Dibutyl tin dilaurate | 0.31 | 0.31 | 3.09 | 3.09 | 0.31 | 0.31 | 3.09 | 3.09 |
| Zinc Catalyst | 0.12 | 0.12 | 1.23 | 1.23 | 0.12 | 0.12 | 1.23 | 1.23 |
| AROMATIC ® 150 | 10.1 | 11.78 | 5.35 | 6.03 | 19.54 | 20.36 | 13.7 | 13.06 |
| DESMODUR ® Z-4470 | 0 | 0 | 5.64 | 9.73 | 0 | 0 | 8.21 | 13.33 |
| DESMODUR ® N-3300 | 3.25 | 5.76 | 0 | 0 | 4.81 | 8.07 | 0 | 0 |

Each of the coating compositions B-I was applied to two thermoplastic polyolefin panels. Prior to applying the coating compositions, one panel was wiped with a cloth saturated with cleaning solution 5 while the other panel was wiped with a cloth saturated with the Comparative Plastic Cleaner. After the thermoplastic polyolefin panels were wiped, the coating compositions were applied with a bird type applicator having a 0.254 mm (0.010 inch) clearance. The panels were flashed for 30 minutes then baked in an oven at 82° C. (180° F.) for 30 minutes. After the panels had cooled for one hour, the coating was tested for X-hatch and cross hatch adhesion. The results of the testing are shown in Table 4

TABLE 4

| Coating Composition | X Hatch using Cleaning Solution 5 | X Hatch using Comparative Plastic Cleaner | Cross Hatch using Cleaning Solution 5 | Cross Hatch using Comparative Plastic Cleaner |
|---|---|---|---|---|
| B | 0 | 0 | 2 | 0 |
| C | 10 | 0 | 10 | 0 |
| D | 10 | 0 | 10 | 1 |
| E | 10 | 0 | 10 | 2 |
| F | 0 | 0 | 0 | 0 |
| G | 10 | 0 | 10 | 4 |
| H | 10 | 0 | 9 | 0 |
| I | 0 | 0 | 5 | 0 |

From the foregoing experiment it can be seen that cleaning solutions having a telechelic diol produce coatings with generally excellent adherence to thermoplastic polyolefin panels.

Cleaning solutions 6-11 were prepared by adding KRASOL® HLBH-P 3000 polybutadiene to PLAS-STICK® 2320 plastic cleaner and mixing until a homogeneous solution was formed as shown as in Table 5. All amounts shown are in parts by weight.

TABLE 5

| Cleaning Solution | Parts of PLAS-STICK ® 2320 plastic cleaner | Parts of KRASOL ® HLBH-P 3000 polybutadiene | Weight percent of telechelic diol |
|---|---|---|---|
| 6 | 504 | 6 | 1 |
| 7 | 588 | 12 | 2 |
| 8 | 582 | 18 | 3 |
| 9 | 576 | 24 | 4 |
| 10 | 570 | 30 | 5 |
| 11 | 564 | 36 | 6 |

Cleaning solutions 6-11 and the Comparative Plastic Cleaner containing no telechelic diol were used to clean thermoplastic polyolefin panels. Coating composition C was then coated on each of these panels using a bird type applicator having a 0.254 mm (0.010 inch) clearance. The panels were baked in an oven at 82° C. (180° F.) for 30 minutes. After the panels had cooled for one hour, the coating was tested for X-hatch and cross hatch adhesion and retested after 3 days.

A second set of panels was cleaned using cleaning solutions 6-11 and Comparative Plastic Cleaner containing no telechelic diol. Coating composition G was then coated on each of these panels using a bird type applicator having a 0.254 mm (0.010 inch) clearance. The panels were flashed for 30 minutes then baked in an oven at 82° C. (180° F.) for 30 minutes. After the panels had cooled for one hour, the coating was tested for X-hatch and cross hatch adhesion and retested after 3 days. The results of these tests are shown in Table 6.

TABLE 6

| Coating Composition | Cleaning Solution | X Hatch (1 hour) | Cross Hatch (1 hour) | X Hatch (3 day) | Cross Hatch (3 day) |
|---|---|---|---|---|---|
| C | Comparative Plastic Cleaner | 0 | 0 | 0 | 0 |
| | 6 | 0 | 0 | 0 | 1 |
| | 7 | 0 | 3 | 0 | 3 |
| | 8 | 0 | 0 | 0 | 0 |
| | 9 | 0 | 9 | 0 | 8 |
| | 10 | 0 | 2 | 0 | 5 |
| | 11 | 10 | 9 | 5 | 10 |
| G | Comparative Plastic Cleaner | 0 | 0 | 0 | 0 |
| | 6 | 10 | 10 | 10 | 10 |
| | 7 | 10 | 10 | 10 | 10 |
| | 8 | 10 | 10 | 10 | 10 |
| | 9 | Beading[1] | Beading[1] | Beading[1] | Beading[1] |
| | 10 | 10 | 10 | 10 | 10 |
| | 11 | 10 | 10 | 10 | 10 |

[1]The coating composition beaded up on the thermoplastic polyolefin substrate. It is thought that the surface was inadvertently not wiped with Cleaning Solution 9 prior to spraying the composition. Based upon the other results of Coating composition G, this result is considered an anomaly.

From the foregoing experiment it can be seen that increasing levels of telechelic diol in a plastic cleaner solution produces an increasingly adhesive coating on a polyolefin substrate.

Coating compositions J-M were prepared by mixing the ingredients in Table 7, in the order shown, in a mixing vessel. All amounts are in parts by weight.

TABLE 7

| Ingredient | Coating Composition J | K | L | M |
|---|---|---|---|---|
| Acrylic Polymer #1 | 34.84 | 33.07 | 34.84 | 33.02 |
| Telechelic diol[1] | 0 | 1.46 | 0 | 0 |
| Telechelic diol[2] | 0 | 0 | 0 | 1.17 |
| Dibutyl tin dilaurate | 3.09 | 3.09 | 3.09 | 3.09 |
| Zinc Catalyst | 1.23 | 1.23 | 1.23 | 1.23 |
| Methyl amyl ketone | 2.59 | 2.82 | 2.59 | 2.97 |
| Cyclohexanone | 2.59 | 2.82 | 2.59 | 2.97 |
| DESMODUR ® Z-4470 | 5.64 | 5.46 | 5.64 | 5.51 |

[1]KRASOL ® HLBH-P 3000 polybutadiene
[2]KRASOL ® HLBH-P 2000 polybutadiene

The following cleaning solutions were prepared by adding KRASOL® HLBH-P 3000 polybutadiene to PLAS-STICK® 2320 plastic cleaner and mixing until a homogeneous solution was formed. Unless otherwise noted, all amounts shown in table 8 are in parts by weight.

TABLE 8

| Cleaning Solution | Parts of PLAS-STICK ® 2320 plastic cleaner | KRASOL ® HLBH-P 3000 polybutadiene | KRASOL ® HLBH-P 2000 polybutadiene | Weight percent of telechelic diol |
|---|---|---|---|---|
| 12 | 99.5 | 0.5 | 0 | 0.5 |
| 13 | 99.5 | 0 | 0.5 | 0.5 |
| 14 | 99 | 1 | 1 | 1 |
| 15 | 99 | 0 | 1 | 1 |

Thermoplastic polyolefin panels were prepared by wiping one side of each panel with cleaning solutions 12-15 or the Comparative Plastic Cleaner. Coating compositions J-M were then applied to each panel using a bird type applicator having a 0.254 mm (0.010 inch) clearance. The panels were flashed for 30 minutes then baked in an oven at 82° C. (180° F.) for 30 minutes. After the panels had cooled for one hour, the coating was tested for X-hatch and cross hatch adhesion. A second set of panels was prepared according to the above procedure, except that the panels were baked at 121° C. rather than 82° C. After the panels had cooled for one hour, the coating was tested for X-hatch and cross hatch adhesion. Adhesion test results are shown in table 9.

TABLE 9

| Coating Composition | Cleaning Solution | 82° C. X Hatch | 82° C. Cross Hatch | 121° C. X Hatch | 121° C. Cross Hatch |
|---|---|---|---|---|---|
| J | Comparative Plastic Cleaner | 0 | 0 | 0 | 2 |
| K | | 1 | 8 | 3 | 8 |
| L | | 0 | 3 | 0 | 0 |
| M | | 5 | 8 | 10 | 10 |
| J | 12 | 0 | 3 | 0 | 1 |
| K | | 10 | 8 | 10 | 10 |
| L | | 0 | 4 | 0 | 0 |
| M | | 10 | 6 | 10 | 10 |
| J | 13 | 0 | 2 | 0 | 0 |
| K | | 10 | 7 | 10 | 10 |
| L | | 0 | 4 | 0 | 3 |
| M | | 10 | 7 | 10 | 10 |
| J | 14 | 0 | 3 | 0 | 3 |
| K | | 5 | 10 | 10 | 10 |
| L | | 0 | 1 | 0 | 3 |
| M | | 10 | 10 | 10 | 10 |
| J | 15 | 0 | 3 | 0 | 0 |
| K | | 10 | 8 | 10 | 10 |
| L | | 0 | 5 | 0 | 5 |
| M | | 10 | 9 | 10 | 10 |

From the foregoing experiment it can be seen that even low levels of the telechelic diol in the plastic cleaning solution produce a coating that adheres to a plastic substrate, especially if low levels of the telechelic diol are added to the coating composition.

The invention claimed is:

1. A process for producing an adherent coating on a resinous substrate, said process comprising the steps of;

i) contacting surface of said resinous substrate with an adhesion promoting cleaning solution to clean said surface, said cleaning solution comprising at least one telechelic diol in a carrier liquid;

ii) applying a layer of a coating composition on said cleaned surface of said substrate, and iii) curing said layer of said coating composition into said adherent coating on said resinous substrate wherein the telechelic diol is a saturated hydrocarbon polymer containing less than 13 percent by weight of heteroatoms and the saturated hydrocarbon polymer has a number average molecular weight in the range of from 1000 to 20,000.

2. The process of claim 1 further comprising drying said layer of a coating composition after said step (ii).

3. The process of claim 1 wherein said curing step takes place at temperatures ranging from ambient to 100° C.

4. The process of claim 1 wherein said coating composition is a primer.

5. The process of claim 1 wherein said carrier liquid comprises one or more solvents.

6. The process of claim 5 wherein the solvent is selected from the group consisting of alkanes and cycloalkanes having from 5 to 20 carbon atoms, aromatics, esters, ethers, ketones, and a combination thereof.

7. The process of claim 1 wherein said coating composition comprises a) a crosslinkable component having a hydroxyl number in the range of from 2 to 200, b) a telechelic diol, and c) a crosslinking component comprising at least one polyisocyanate.

8. The process of claim 7 wherein said crosslinkable component is selected from the group consisting of acrylic polyol, polyester polyol, and a combination thereof.

9. The process of claim 8 wherein the crosslinkable component comprises in the range of from 1 percent by weight to 99 percent by weight of said acrylic polyol and the crosslinkable component also contains in the range of from 99 percent by weight to 1 percent by weight of said polyester polyol, wherein said percentage by weight is based upon the total weight of said acrylic polyol and said polyester polyol.

10. The process of claim 7 wherein said polyisocyanate is selected from the group consisting of cycloaliphatic diisocyanate, the isocyanurate trimer of cycloaliphatic diisocyanate, and a combination thereof.

11. The process of claim 10 wherein said polyisocyanate is selected from the group consisting of isophorone diisocyanate, the isocyanurate of isophorone diisocyanate, and a combination thereof.

12. The process of claim 7 wherein said telechelic diol in said coating composition ranges from 0.5 weight percent to less than 5 weight percent based on the total weight of said components a), b) and c).

13. The process of claim 1 wherein said substrate is made of thermoplastic polyolefins or reinforced reaction injected molding urethane.

14. The process of claim 1 wherein said substrate is an automotive body, automotive fender or automotive interior part.

15. A process for producing an adherent multi-coating on a resinous substrate, said process comprising the steps of;

i) contacting surface of said resinous substrate with an adhesion promoting cleaning solution to clean said surface, said cleaning solution comprising at least one telechelic diol in a carrier liquid;

ii) applying a layer of a primer on said cleaned surface of said substrate, iii) optionally curing or partially curing said layer of said primer;

iv) applying a layer of a pigmented coating composition over said partially cured layer of said primer; and v) completing curing of said partially cured layer of said primer and said layer of said pigmented coating composition to form said adherent multi-coating on said resinous substrate wherein the telechelic diol is a saturated hydrocarbon polymer containing less than 13 percent by weight of heteroatoms and the saturated hydrocarbon polymer has a number average molecular weight in the range of from 1000 to 20,000.

16. The process of claim 15, wherein said process further comprises the step applying a layer of clearcoat composition to the pigmented coating composition prior to curing the at least partially cured primer and said layer of said pigmented coating composition to form said adherent multi-coating on said resinous substrate.

* * * * *